United States Patent [19]

Helm et al.

[11] 4,358,021

[45] Nov. 9, 1982

[54] SEPARATED RING SEGMENT DUAL PIVOT LIFT CRANE

[75] Inventors: Percy R. Helm; James G. Morrow, Sr., both of Manitowoc, Wis.

[73] Assignee: The Manitowoc Company, Inc., Manitowoc, Wis.

[21] Appl. No.: 128,139

[22] Filed: Mar. 7, 1980

[51] Int. Cl.[3] ..... B66C 23/74

[52] U.S. Cl. ..... 212/195

[58] Field of Search ..... 212/178, 195, 196, 232, 212/198

[56] References Cited

U.S. PATENT DOCUMENTS

| | | | |
|---|---|---|---|
| 3,836,010 | 9/1974 | Lampson | 212/195 |
| 3,930,583 | 1/1976 | Jouffray | 212/195 |

FOREIGN PATENT DOCUMENTS

| | | |
|---|---|---|
| 1203920 | 9/1970 | United Kingdom . |
| 1466686 | 3/1977 | United Kingdom . |
| 2050295A | 1/1981 | United Kingdom . |
| 2053146A | 2/1981 | United Kingdom . |
| 2053147A | 2/1981 | United Kingdom . |

*Primary Examiner*—Robert W. Saifer

*Attorney, Agent, or Firm*—Leydig, Voit, Osann, Mayer & Holt, Ltd.

[57] ABSTRACT

Front and rear pairs of crawler assemblies are provided for supporting separated ring segments disposed forwardly under the boom and rearwardly under the counterweight so the crane can travel under load and swing through at least a partial horizontal arc with separate pivots for the boom and counterweight. One and preferably both crawler assemblies are selectively and reversely powered to facilitate forward and reverse as well as turning movement during travel under loaded and unloaded conditions.

5 Claims, 7 Drawing Figures

SEPARATED RING SEGMENT DUAL PIVOT LIFT CRANE

This invention relates generally to lift cranes and more particularly concerns a mobile segmented ring supported crane with dual pivots.

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383 and 3,878,944. In this design, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

Further refinements in ring supported cranes are disclosed in U.S. Pat. Nos. 4,042,115 and 4,103,783 and copending U.S. applications Ser. Nos. 058,284 and 058,285. These patents and applications disclose inter alia that a separate transporter mechanism may be run in and out of an otherwise stationary ring supported crane in order to move that crane between different locations or transporter mechanisms and/or idle crawlers or dollies may be installed beneath the ring under the boom foot and counterweight.

The primary aim of the present invention is to provide a heavy lift crane assembly having an upper structure including machine works and a counterweight pivotally mounted for movement on a ring structure with a boom and mast mounted on a boom carrier for rotation on a ring segment spaced outwardly from and with a different pivot axis than the main ring. Also provided are means interconnecting the counterweight carrier and the boom top and traveling supports for the main ring and auxiliary ring segments, including front and rear pairs of laterally spaced crawler assemblies respectively located under the main ring under the counterweight and under the auxiliary ring segment beneath the boom carrier with means for selectively and reversibly driving the tracks to permit movement of the crane and separated ring segments over the ground while the boom is lifting a load.

Other objects and advantages of the invention will become apparent upon reading the following detailed description and upon reference to the drawings, in which.

Figure 1:
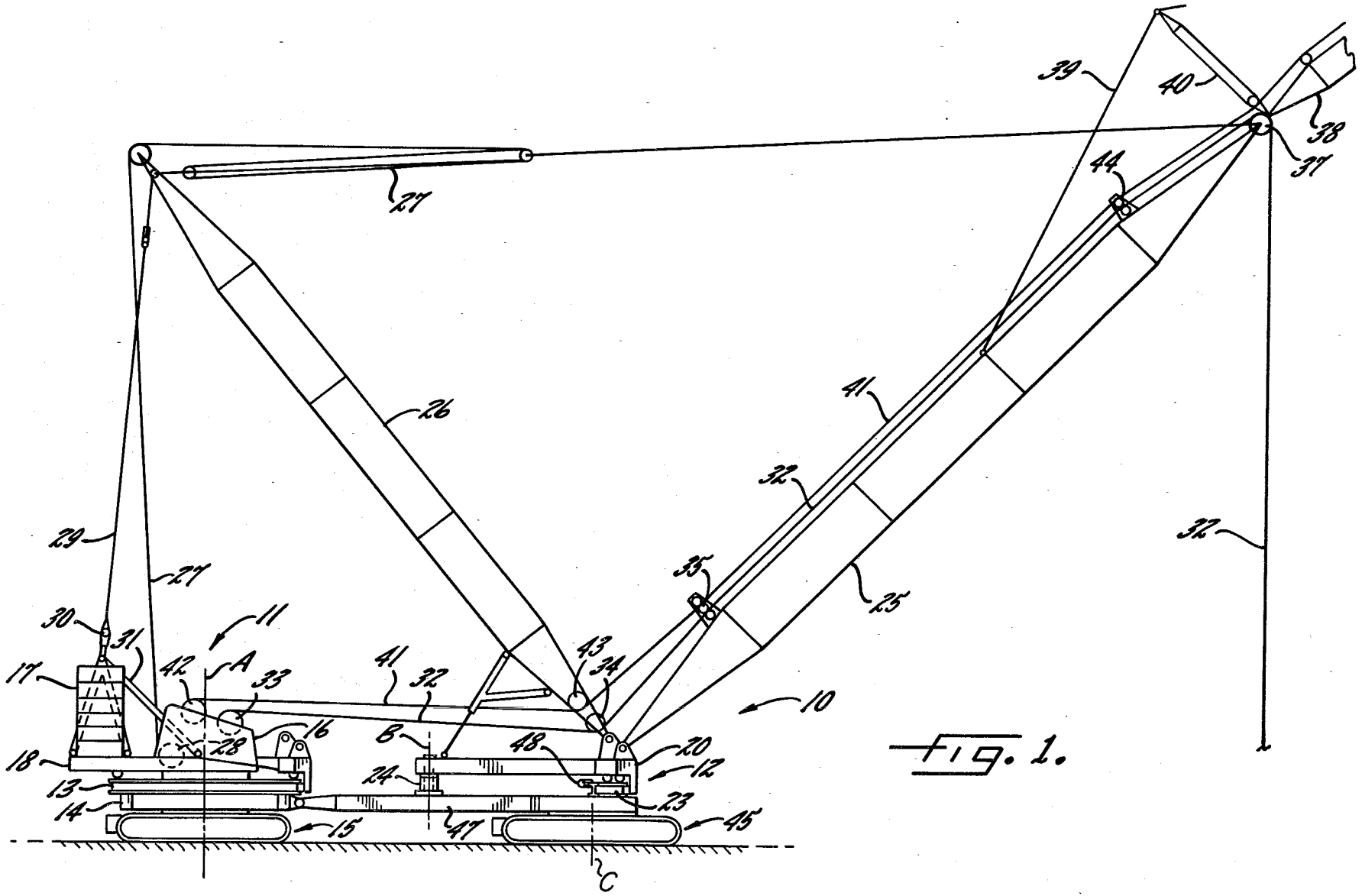
FIG. 1 is a side elevation of the separated ring segment dual pivot lift crane of the present invention.

Turning now to the drawings, there is shown in FIG. 1 a segmented ring supported lift crane 10 of the present invention. The crane 10 includes a rear machinery and counterweight support mechanism 11 and a front boom and mast support mechanism 12. In the illustration of FIG. 1 the machinery and counterweight support mechanism 11 includes a large diameter ring 13 supported by a substantially rectangular frame 14 on a self propelled transporter mechanism 15 substantially as disclosed in copending U.S. application Ser. No. 899,230, now U.S. Pat. No. 4,195,740 which is hereby incorporated by reference. Suffice it to say that the ring-like track 13 is on the order of 36 feet in diameter and the lift machinery 16 and counterweight 17 are supported on a rotatable deck 18 for movement about the ring center line designated A.

Figure 3:
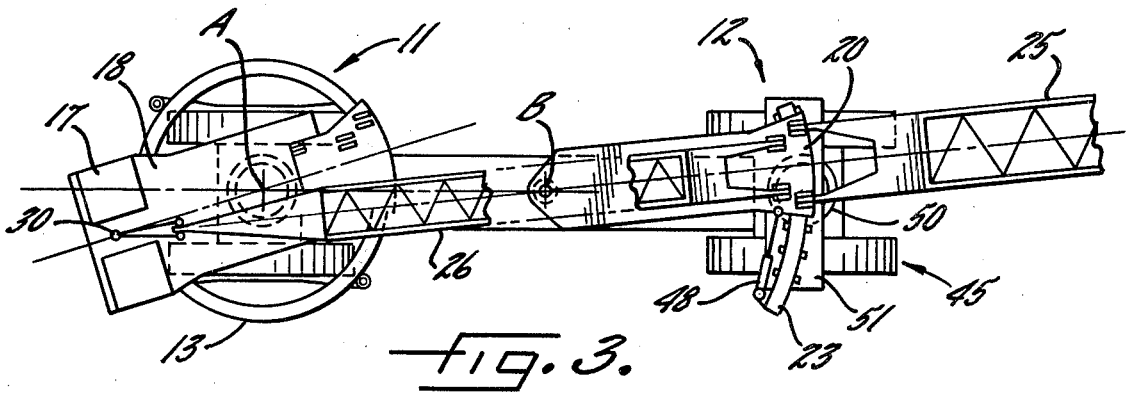
Figure 4:
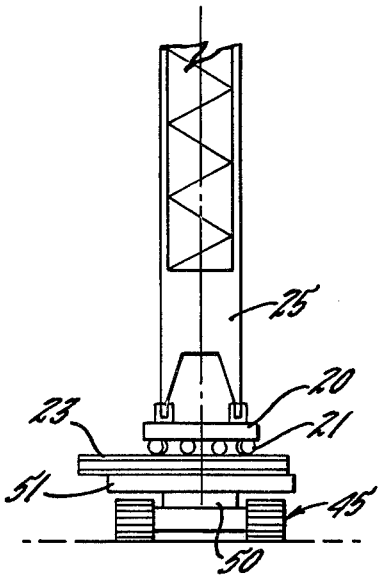
FIGS. 4 and 5 are fragmentary front elevations of the crane shown in FIG. 1 with a single boom illustrated in FIG. 4 and dual booms illustrated in broken lines in FIG. 5; and, FIGS. 6 and 7 are fragmentary side elevations, similar to FIG. 1, of two alternative embodiments of the invention.
Figure 5:
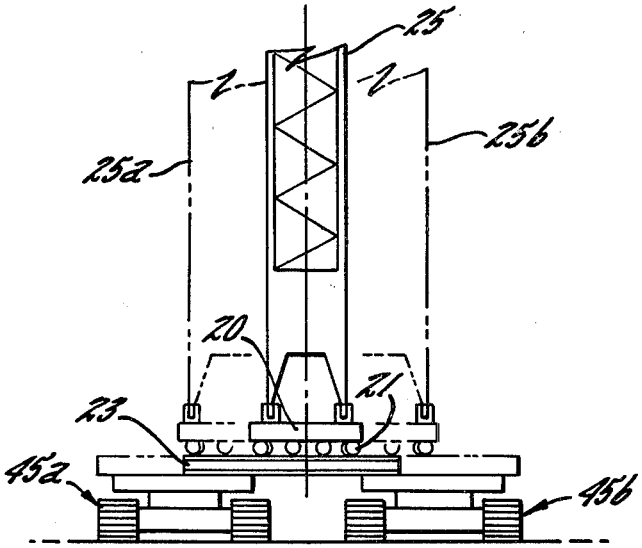

The front boom and mast carrier mechanism 12 includes a carrier 20 supported by rollers 21, best shown in FIGS. 4 and 5, on a front ring segment 23 which has a radius having as its center pivot axis B on a subframe 24 separated longitudinally from the axis A of the rear ring 13. The front and rear ring segments, indicated by numerals 23 and 13 respectively, may have either the same or different radii. The carrier 20 pivotally mounts a forwardly inclined boom 25 and a rearwardly inclined mast 26. The tip of the mast 26 is connected to the tip of the boom 25 by variable length rigging 27 which includes a multiple part line wound on a boom hoist drum 28 located on the machinery deck 18. The upper end of the mast 26 is also connected by means of a fixed length pendant 29 through a universal swivel connection 30 to a gantry 31 carried on the machinery deck 18. In this way the counterweight 17 is connected to the mast top and, through the rigging 27, is applied to the boom tip to counteract the moment of a heavy load. The swivel connection 30 substantially eliminates torsionally induced loads in the pendants 29 due to the mast pivoting about Axis B while the counterweight pivots about Axis A (see FIG. 3).

In the configuration shown in FIG. 1 the crane 10 includes a primary lift line 32 wound on a winch drum 33 and reeved around guide sheaves 34 and 35 and a boom tip sheave 37. The boom 25 is also provided with a jib section 38 supported by guy pendants 39 and a strut 40. An auxiliary lift line 41 is wound on another drum 42 and is guided by sheaves 43 and 44 to the tip (not shown) of the jib 38.

Pursuant to the present invention the front boom support mechanism 12 is carried on a transporter assembly 45 interconnected by a frame element 47 to the rear machinery transporter 15. The front transporter 45 rotates about axis C and is preferably a demountable self propelled assembly such as shown in U.S. Pat. Nos. 4,000,784 and 4,069,884 which are incorporated herein by reference.

It will be appreciated that by suitable controlling the front transporter assembly 45 and the rear machinery transporter 15 the crane 10 may be moved over the terrain in either a loaded or an unloaded condition.

In keeping with another aspect of the invention, the boom carrier 20 is rotatable on the front ring segment 23 in order to swing a load through a limited arc. Swinging movement may be provided through hydraulic swing cylinders 48 or, alternatively, the carrier 20 may be rotated on its ring segment 23 by one or more independent swing drive mechanisms such as shown in U.S. Pat. Nos. 3,949,881 and 4,013,174 which are also incorporated herein by reference.

Figure 2:
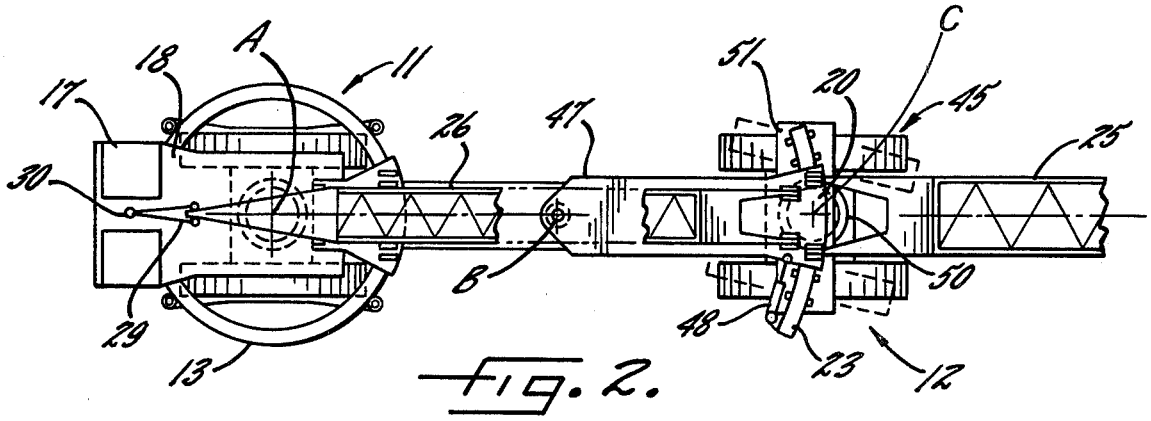
FIGS. 2 and 3 are fragmentary top views showing, respectively, in line and swing positions of the boom and counterweight.

As shown in FIG. 2, the front transporter assembly 45 is provided to support the ring segment 23 and carries a pivot ring 50 on which a base plate 51 is mounted. This permits the transporter mechanism 45 to be propelled, as disclosed in U.S. Pat. No. 4,069,884 to move in forward, reverse or turning directions (the latter being shown in broken lines). Since the transporter 45 supports the ring segment 23 on which the boom carrier 20 rides, the crane 10 may move under either loaded or unloaded conditions.

According to the present invention, heavy lifts and placement of loads can also be made which require swinging the load through a limited arcuate segment. This is particularly useful in accurately placing a heavy load on mounting blocks, bolts or the like.

It will be appreciated, of course, that a single boom 25 may be supported by the front carrier 20, as shown in FIG. 4 or spaced-apart dual booms 25*a* and *b* may be provided (as shown in broken lines of FIG. 5). In the latter instance it is desirable to provide dual transporter mechanisms 45, while a single front transporter may be sufficient if a single boom 25 and only limited swinging of the load is contemplated for a particular lift.

Figure 6:
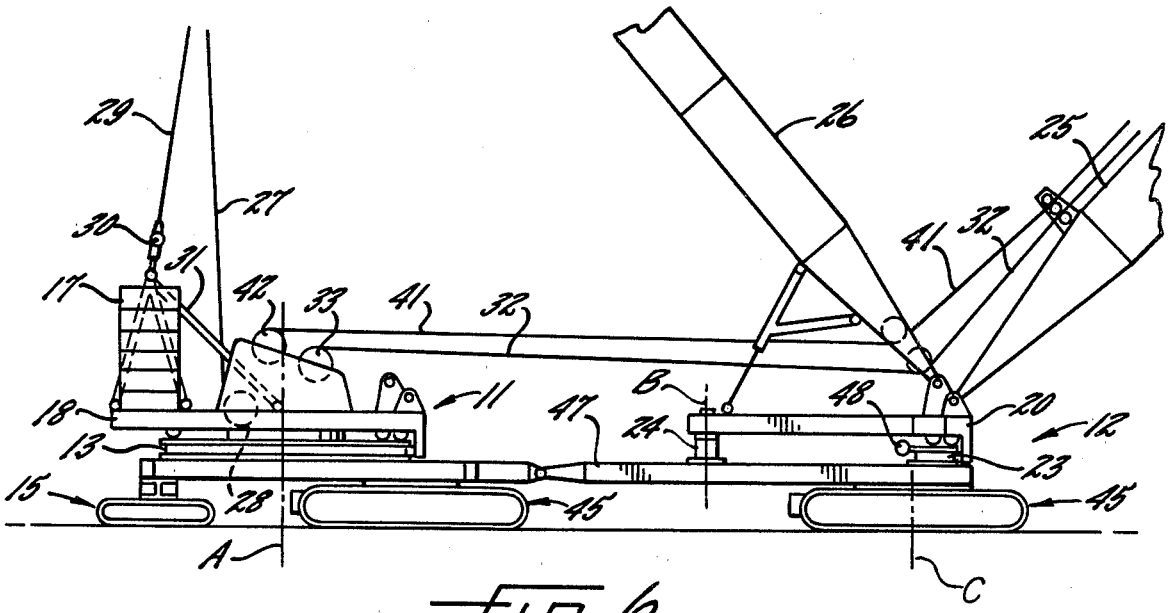

Turning now to FIG. 6, another embodiment of the heavy lift crane is illustrated. As shown here, the rear lift machinery and counterweight support is substantially the same as that disclosed in copending U.S. application Ser. No. 058,284 which is incorporated by reference. Otherwise, this unit is generally similar to that shown in FIG. 1 and similar reference numerals are used for similar parts.

Figure 7:
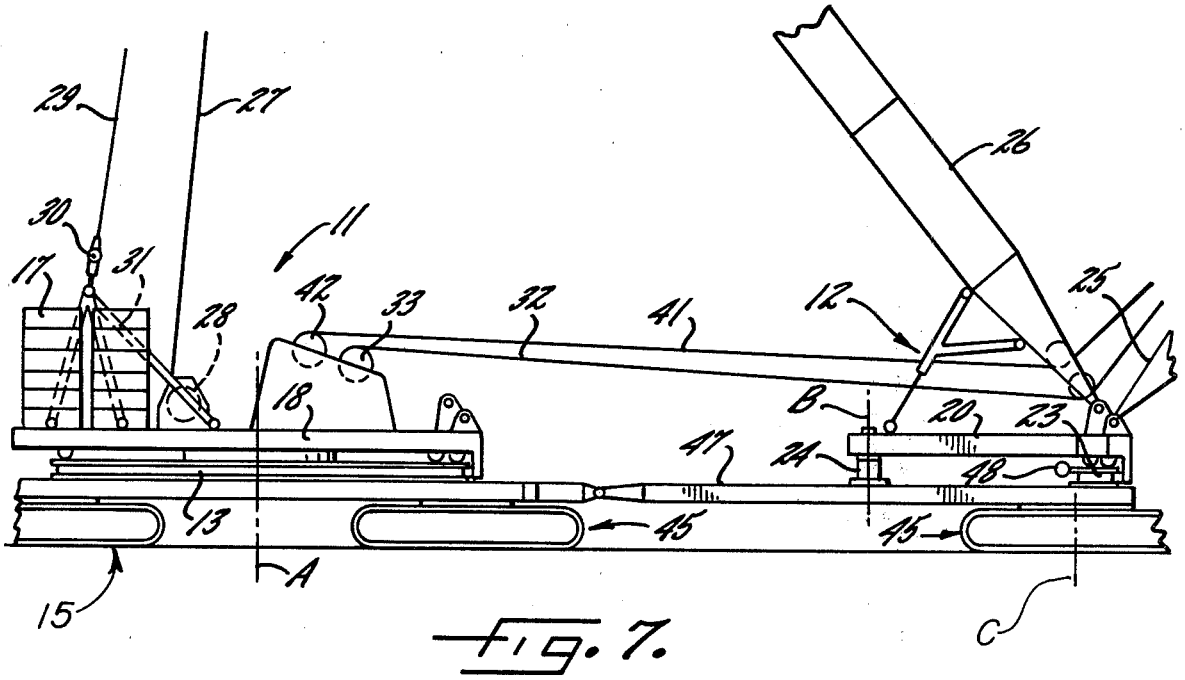

In FIG. 7 another embodiment is shown based on an enlarged 60 foot rear ring mounted on self-propelled transporters 15 (which may be single or dual units) similar to the transporter 45 in FIG. 1. The basic ring structure and machinery deck for the embodiment of FIG. 7 may be substantially the same as that disclosed in U.S. Pat. No. 4,103,783 (which is incorporated herein by reference) as modified by the addition of the transporter assemblies 15*a* and *b*. In other respects reference numbers similar to FIG. 1 are employed.

It should also be appreciated that the embodiments shown in side elevation in FIGS. 6 and 7 may employ either single or dual front transporter assemblies 45 (as shown in FIGS. 4 and 5) and either single or dual booms 25 (as shown in FIG. 5).

From the foregoing, it will be seen that a heavy lift crane is provided utilizing a standard "Ringer" crane as the rear lift machinery and counterweight support and a front ring segment assembled from standard "Ringer" components for supporting the boom and mast and transmitting the load down through a self-propelled transporter assembly into the ground.

We claim as our invention:

1. A lift crane with separated front and rear ring segments and dual pivots for a forwardly extending boom and a rearwardly disposed counterweight comprising, in combination, a forwardly inclined boom and a rearwardly inclined mast pivotally mounted on a boom carrier roller mounted on a front ring segment supported by a front transporter assembly, said carrier being pivoted about a first vertical axis and said transporter assembly being pivoted about a second vertical axis, a counterweight roller mounted on a rear ring segment supported by a rear transporter assembly, said counterweight being pivoted about a third vertical axis means interconnecting said front and reartransporter said first vertical axis, and means interconnecting the tip of the boom, the tip of the mast and the counterweight including a swivel connection between the mast tip and counterweight to permit limited swinging movement of said mast and boom about said first vertical axis and swinging movement of said counterweight about said third vertical axis.

2. The combination defined in claim 1 wherein said first and third vertical pivots are spaced longitudinally from one another.

3. The combination defined in claim 2 wherein said front and rear ring segments have the same radius.

4. The combination defined in claim 2 wherein said front and rear ring segments have different radii.

5. The combination defined in claim 1 including means for swinging said boom carrier about said first vertical axis independent of swinging said counterweight about said third vertical axis.

* * * * *